US007648263B2

(12) United States Patent
Bartlett et al.

(10) Patent No.: US 7,648,263 B2
(45) Date of Patent: Jan. 19, 2010

(54) PUSH BUTTON RELEASE FOR LUMINAIRES IN A TRACK LIGHTING SYSTEM

(75) Inventors: Paul James Bartlett, Newnan, GA (US); Gregg Arthur Lehman, Peachtree City, GA (US); Chiu Hwa Jung, Shenzhen (CN)

(73) Assignee: Cooper Technologies Company, Houston, TX (US)

( * ) Notice: Subject to any disclaimer, the term of this patent is extended or adjusted under 35 U.S.C. 154(b) by 248 days.

(21) Appl. No.: 11/980,303

(22) Filed: Oct. 30, 2007

(65) Prior Publication Data

US 2009/0109707 A1 Apr. 30, 2009

(51) Int. Cl.
*F21V 21/35* (2006.01)

(52) U.S. Cl. ..... 362/648; 362/147

(58) Field of Classification Search ..... 362/147, 362/148, 217.02, 217.05, 217.06, 217.08, 362/217.16, 217.17, 368, 404, 648; 248/222.51, 248/222.52, 221.11, 222.111, 342, 343
See application file for complete search history.

(56) References Cited

U.S. PATENT DOCUMENTS

| | | | | |
|---|---|---|---|---|
| 999,860 | A | 8/1911 | Perry et al. | |
| 1,083,530 | A | 1/1914 | Gallay | |
| 1,115,033 | A | 10/1914 | Stearns | |
| 2,802,094 | A | 8/1957 | Grosz | |
| 4,688,154 | A | 8/1987 | Nilssen | |
| 5,017,327 | A | 5/1991 | Bamber | |
| 5,017,838 | A | 5/1991 | Nilssen | |
| 5,128,847 | A * | 7/1992 | Lin et al. | 362/648 |
| 5,154,509 | A | 10/1992 | Wulfman et al. | |
| 5,702,177 | A * | 12/1997 | Lin | 362/648 |
| 5,833,358 | A | 11/1998 | Patik | |
| 6,227,884 | B1 | 5/2001 | Hierzer | |
| 6,244,733 | B1 | 6/2001 | Fong et al. | |
| 6,383,013 | B1 | 5/2002 | Ghesla et al. | |
| 6,669,355 | B2 | 12/2003 | Layne et al. | |
| 6,716,042 | B2 | 4/2004 | Lin | |
| 7,038,380 | B2 | 5/2006 | Hsu | |
| 7,160,001 | B2 | 1/2007 | Bartlett | |
| 7,160,011 | B2 | 1/2007 | Wang | |
| D537,193 | S | 2/2007 | Lehman et al. | |
| D546,497 | S | 7/2007 | Lehman et al. | |
| D549,388 | S | 8/2007 | Lehman et al. | |
| 7,416,422 | B2 | 8/2008 | Lehman et al. | |

(Continued)

OTHER PUBLICATIONS

U.S. Appl. No. 11/928,540, Bartlett et al.

(Continued)

*Primary Examiner*—David V Bruce
(74) *Attorney, Agent, or Firm*—King & Spalding LLP

(57) ABSTRACT

The invention provides an apparatus for engaging and disengaging a track lighting assembly with respect to a track in a track lighting system. The apparatus includes a track engaging apparatus that includes a housing. The housing includes a rotation inhibitor that has a protruding end that protrudes from the housing for engaging with the track and preventing the track engaging apparatus from rotating with respect to the track. The rotation inhibitor further includes a receiving member for translating a force in a first direction into motion of the rotation inhibitor in a second direction substantially orthogonal to the first direction. The apparatus further includes an actuator for applying the force in the first direction to the receiving member.

19 Claims, 5 Drawing Sheets

U.S. PATENT DOCUMENTS

| | | | | |
|---|---|---|---|---|
| 7,425,140 | B2 | 9/2008 | Lehman et al. | |
| 7,520,762 | B2 | 4/2009 | Lehman et al. | |
| 7,563,016 | B1 * | 7/2009 | Mier-Langner et al. | ..... 362/648 |
| 2003/0003785 | A1 | 1/2003 | Ross | |
| 2007/0015388 | A1 | 1/2007 | Boike | |
| 2007/0153309 | A1 | 7/2007 | Sasanuma et al. | |
| 2007/0153509 | A1 | 7/2007 | Lehman et al. | |
| 2007/0153516 | A1 | 7/2007 | Lehman et al. | |
| 2007/0153550 | A1 | 7/2007 | Lehman et al. | |
| 2007/0167043 | A1 | 7/2007 | Lehman et al. | |

OTHER PUBLICATIONS

U.S. Appl. No. 11/929,082, Bartlett et al.

* cited by examiner

PUSH BUTTON RELEASE FOR LUMINAIRES IN A TRACK LIGHTING SYSTEM

TECHNICAL FIELD

The present invention relates generally to track lighting systems, and more specifically to a push button device for releasing a luminaire from a track forming a part of a track lighting system.

BACKGROUND OF THE INVENTION

The use of track lighting systems is well known in the art. U.S. Pat. No. 7,160,001, the disclosure of which is herein incorporated by reference, describes a standard track lighting system. Generally, a track lighting system provides a track that is mounted to a wall or ceiling, and is further connected to an electrical power source. The track provides a conductor that transmits electrical power down the length of the track, as well as support for luminaires connected to the track. One or more luminaires are generally coupled to the track.

Track lighting systems provide a convenient way to modify the light distribution in a given area. Because luminaires may be easily added, removed, or placed in different locations along the track with minimal effort, luminaires can be added or changed without the costly addition of new fixtures or power supplies.

In prior art track lighting systems, such as the system disclosed in U.S. Pat. No. 7,160,001, track lighting assemblies—which generally include at least a luminaire for providing light, a luminaire connection housing for connecting the luminaire to a track engaging member that engages with the track, and a luminaire connection member that can be coupled to the track—are engaged with the track by placing each luminaire connection member within the track and rotating the track lighting assembly. The track lighting assembly may be similarly rotated in the opposite direction to disengage the track lighting assembly from the track. Prior art track lighting assemblies typically include a latch that engages the track and prevents rotation of the track lighting assembly until the latch is actuated. An example of a prior art latch is shown in FIGS. 1*a* and 1*b*.

Prior art latches, as shown in FIGS. 1*a* and 1*b*, are designed to be operated by placing a thumb or finger on the latch and moving the latch downward while rotating the track lighting assembly. The prior art latches can be difficult to operate. The difficulty of operating the latches is, in itself, a problem in the prior art. Moreover, the difficulty in operating the prior art latches creates a second problem. Because track lighting fixtures are generally installed on ceilings, individuals attempting to operate the latches may be in a position of potential danger when operating the latch, and because the prior art latch requires the application of force in an awkward fashion, the danger associated with changing the prior art track lighting assemblies is amplified.

Accordingly, a need exists for a track engaging apparatus for track lighting assemblies that allows for easier release of the latch that prevents rotation of a luminaire that has been engaged in the track. The latch must provide ease of use, but must also securely prevent rotation of the track lighting assembly while engaged with the track.

SUMMARY OF THE INVENTION

The present invention satisfies the above described needs by providing an apparatus for engaging and disengaging a track lighting assembly with respect to a track in a track lighting system. The apparatus includes a track engaging apparatus that includes a housing. The housing includes a rotation inhibitor that includes a protruding end that protrudes from the housing for engaging with the track and preventing the track engaging apparatus from rotating with respect to the track. The rotation inhibitor further includes a receiving member for translating a force in a first direction into motion of the rotation inhibitor in a second direction substantially orthogonal to the first direction. The apparatus further includes an actuator for applying the force in the first direction to the receiving member.

Applying force to the actuator in the first direction disengages the rotation inhibitor from the track, while removing force from the actuator engages the rotation inhibitor with the track. In additional embodiments the receiving member has a surface disposed at a first angle and the actuator comprises a depressing member for engaging the surface of the receiving member. In other embodiments, an end of the depressing member is disposed at a second angle such that the depressing member engages the surface of the receiving member in a flush manner.

In additional embodiments, the housing further includes an aperture for receiving the actuator. In further additional embodiments, the rotation inhibitor is engaged with a spring having a bias in a third direction opposite to the second direction. The apparatus may also include a spring bracket coupled to the housing for holding an end of the spring in place when the rotation inhibitor moves in the second direction.

Additional aspects, features and advantages of the invention will become apparent to those skilled in the art upon consideration of the following detailed description of illustrated embodiments exemplifying the best mode of carrying out the invention as presently perceived.

DETAILED DESCRIPTION OF EXEMPLARY EMBODIMENTS

The present invention provides a track engaging apparatus that provides a simple push-button release mechanism for releasing a track lighting assembly from a track lighting system. A track engaging apparatus according to the present invention may be released from a track by pressing an actuator that disengages a rotation inhibitor from the track, and by rotating the track lighting assembly.

As used herein, the term "track" refers to any track in a track lighting system, such as, but not limited to, the Halo Power-Trac system available from Cooper Lighting of Peachtree City, Ga. "Track" also refers more generally to any lighting system wherein support for luminaires, as well as electrical power, are provided by one or more track members that may be mounted to a surface such as a wall or ceiling. The term "track lighting assembly" refers to one or more light fixtures that may be coupled to the track which may include at least a luminaire connection housing and a track engaging apparatus. The term "luminaire" refers to the portion of the track lighting assembly that provides light.

Any spatial references herein such as, for example, "upper," "lower," "above," "below," "rear," "between," "vertical," "angular," "beneath," etc., are for the purpose of illustration only and do not limit the specific orientation or location of the described structure.

Figure 1A:
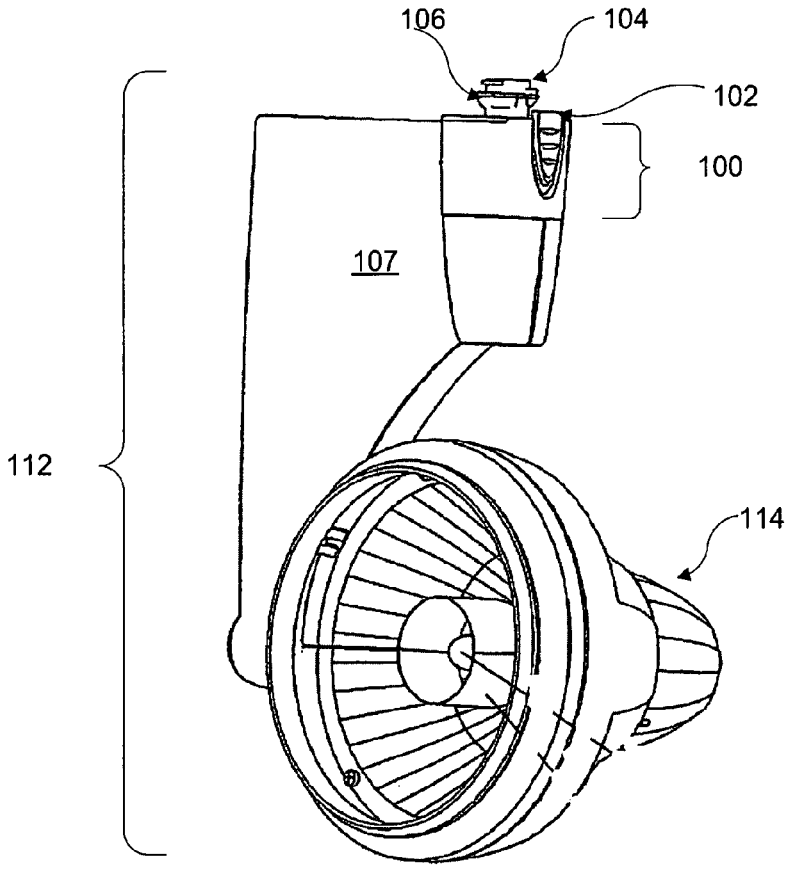
FIG. 1*a* is an illustration of a prior art luminaire and track engaging apparatus.
Figure 1B:
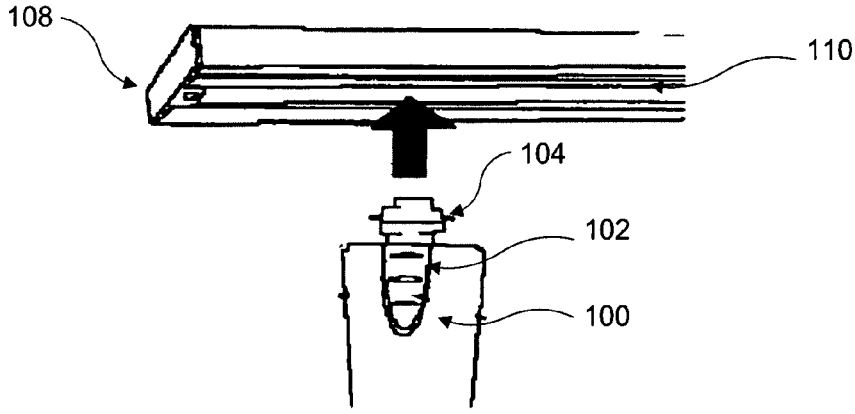
Figure 1b PRIOR ART
FIG. 1*b* is an illustration of a prior art track engaging apparatus engaging a track.

Referring now to the attached figures, in which like numerals represent like elements, certain exemplary embodiments of the present invention will hereafter be described. FIGS. 1*a* and 1*b* are illustrations of a prior art track lighting assembly. The prior art track lighting assembly 112 includes a luminaire 114 coupled to a luminaire connection housing 107, which is coupled to a track engaging apparatus 100. The track engaging apparatus 100 includes a luminaire connecting member 104 for engaging a track 108. The luminaire connecting member 104 includes threads 106 that couple the luminaire connecting member 104 to the track 108, typically by inserting the luminaire connecting member 104 into the track 108 and rotating the track engaging apparatus 100. The rotation causes the threads 106 to engage the track 108, which holds the track engaging apparatus 100 in the track 108. The track engaging apparatus 100 must be further rotated to disengage the track lighting assembly 112 from the track 108. The rotation to disengage the track lighting assembly 112 from the track 108 may be opposite to or in the same direction as the rotation required to engage the track 108.

In order to prevent accidental rotation, and therefore disengagement, of the track engaging apparatus 100 from the track 108, the prior art track engaging apparatus 100 further includes a rotation inhibitor 102 that engages a slot 110 on the track 108. When the rotation inhibitor 102 engages the slot 110, the track engaging apparatus 100 cannot be rotated. Accordingly, the track engaging apparatus 100 cannot disengage the track 108 without first disengaging the rotation inhibitor 102.

The prior art rotation inhibitor 102 is disengaged by manually sliding the rotation inhibitor 102 away from the track. Because the rotation inhibitor 102 must remain firmly in place when the luminaire is engaged with the track 108, downward force must be applied, typically with the thumb. Disengaging the prior art rotation inhibitor 102 often requires an awkward application of force, which can be dangerous when considered in light of the fact that the individual attempting to disengage the luminaire is often standing on a ladder and at risk of a fall.

Figure 2:
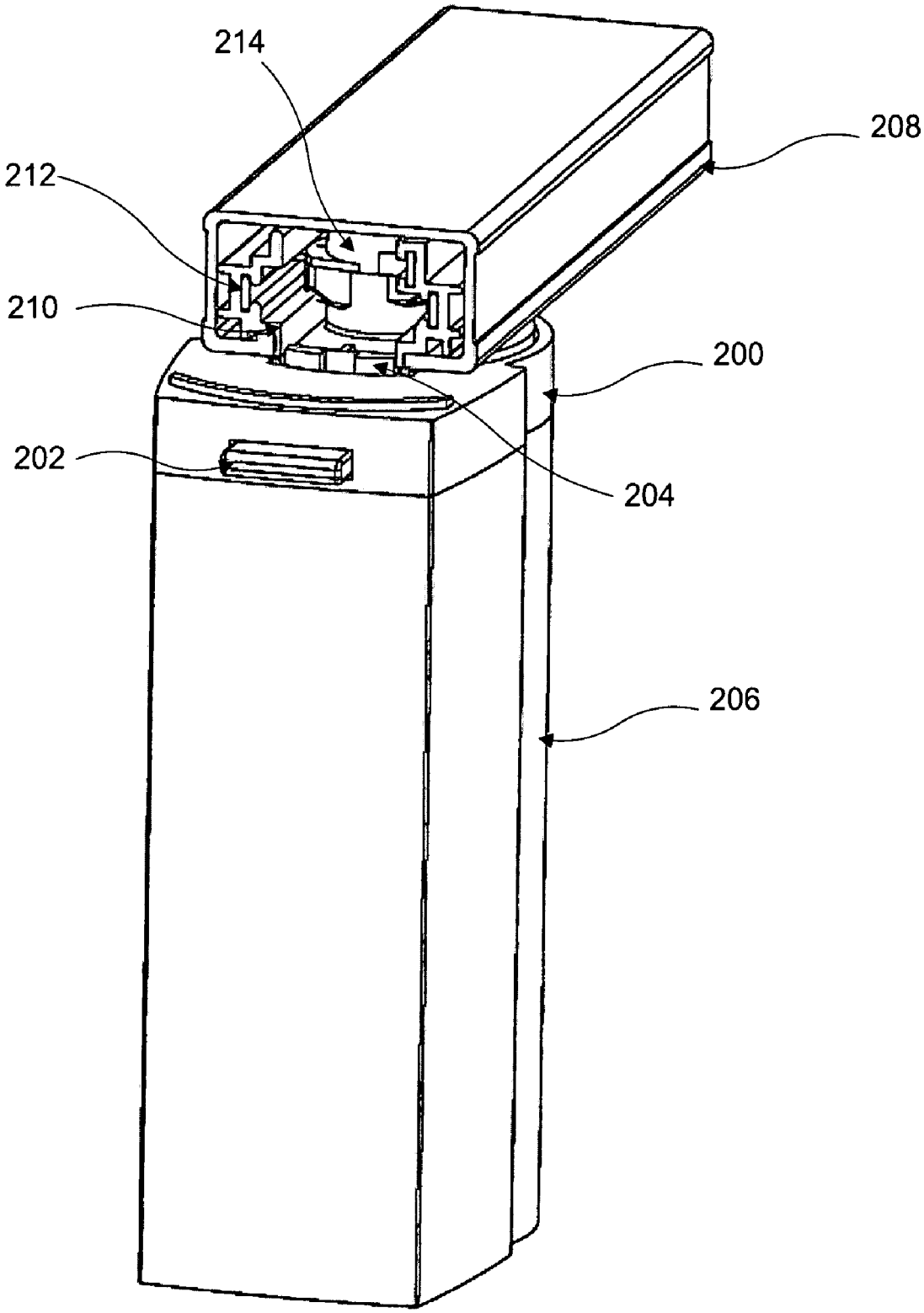
FIG. 2 is a perspective view of an exemplary track engaging apparatus according to the present invention.

To remedy the problems presented by the prior art rotation inhibitor 102, FIG. 2 provides a view of a luminaire having an improved track engaging apparatus according to the present invention. In the embodiment shown in FIG. 2, the track engaging apparatus 200 is coupled to, and is shaped similarly to, a luminaire connection housing 206, which provides support for a luminaire (not shown) and hides the wires (not shown) that provide electricity to the lamp. The track engaging apparatus 200 has an aperture 314 (shown in FIG. 3) to allow wires from the luminaire connection housing 206 to be electrically coupled with the luminaire connecting member 214. Other configurations of the track engaging apparatus 200 are possible. For example, the track engaging apparatus 200 may not be the same size as the luminaire connection housing 206, which may not necessitate an aperture 314 to allow electrical coupling of the luminaire to the luminaire connecting member 214. The track 208 includes a slot 210 that allows the luminaire connecting member 214 to engage conducting members 212 that are coupled to the track 208.

The track engaging apparatus 200 further includes a rotation inhibitor 204 that engages the track 208 in the slot 210. When the rotation inhibitor 204 engages the slot 210, the track engaging apparatus 200—and accordingly the track lighting assembly—cannot be rotated. The track engaging apparatus 200 further includes an actuator 202 for disengaging the rotation inhibitor 204 from the slot 210. The actuator 202 and the rotation inhibitor 204 will be described in further detail below.

Figure 3:
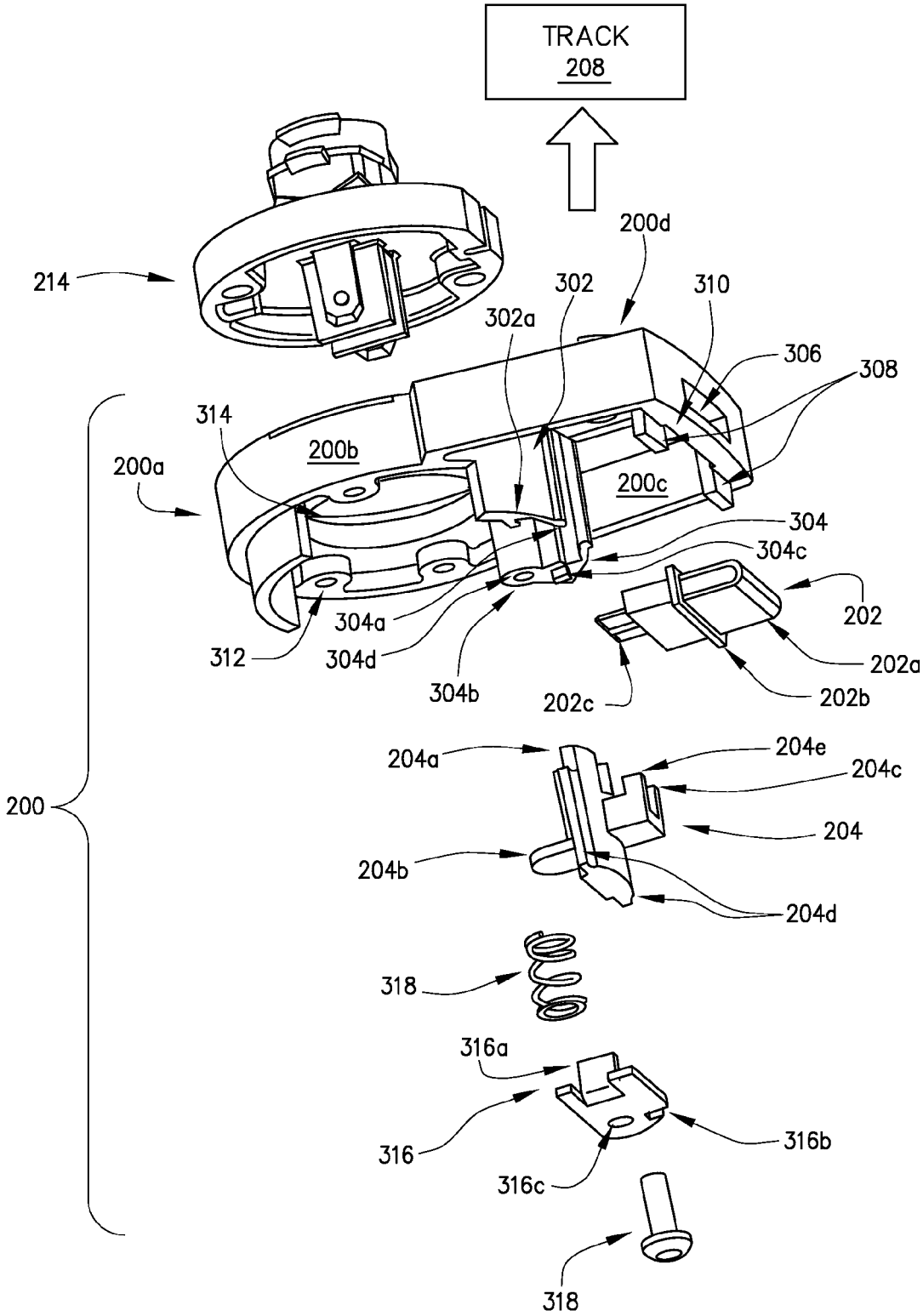
FIG. 3 is an exploded view of an exemplary track engaging apparatus according to the present invention.

FIG. 3 provides an exploded view of an exemplary track engaging apparatus 200 according to the present invention. The exemplary track engaging apparatus 200 includes a housing 200*a* for containing the various parts of the track engaging apparatus 200, as well as for coupling the track engaging apparatus 200 to a luminaire connecting member 214 and a luminaire connection housing 206. The exemplary housing 200*a* is made from metal, but may alternatively be made of plastic or a composite material. The housing 200*a* includes an outer wall 200*b*, an inner wall 200*c*, and a top wall 200*d*.

The housing 200*a* further includes an actuator aperture 306 for receiving the actuator 202. The actuator aperture 306 is shaped substantially similarly to the actuator 202, which will be described in further detail below. The inner wall 200*c* further includes positioning members 308 on either side of the actuator aperture 306. The positioning members 308 can be positioned such that they form a positioning channel 310 that may be larger than the actuator aperture 306. The positioning channel 310 may be sized to accept the widest portion of the actuator 202. The positioning channel 310 may also provide a guide to guide the movement of the actuator 202.

The track engaging apparatus 200 includes guide members 302,304 for supporting and guiding the movement of the rotation inhibitor 204. In an exemplary embodiment, the track engaging apparatus 200 includes two guide members 302, 304. The first guide member 302 defines a guide channel 302*a* that is shaped to accept a first side of the rotation inhibitor 204. The second guide member 304 defines a second guide channel 304*a* that is shaped to accept a second side of the rotation inhibitor 204. The guide channels 302*a*,304*a* may be shaped correspondingly to the shapes of the first and second sides of the rotation inhibitor 204.

In an exemplary embodiment, the second guide member 304 further includes a support member 304*b*. The support member 304*b* provides a support for a spring bracket 316, which will be discussed in further detail below. The support member 304*b* further includes a stabilizing member 304*c* which mates with a correspondingly shaped notch 316*b* in the spring bracket 316, so as to prevent the spring bracket 316 from rotating when coupled to the support member 304*b*. The exemplary stabilizing member 304*c* is a protrusion from the support member 304*b*, which may be rectangular in shape, or of any other suitable shape. The support member 304*b* further includes a fastener aperture 304*d* that engages a fastener 318 for securing the spring bracket 316 to the support member 304*b*. In an exemplary embodiment, the fastener aperture 304*d* is a threaded screw hole and fastener 318 is a screw, although other fasteners 318 and corresponding apertures 304*d* may be used in other embodiments.

The exemplary track engaging apparatus 200 further includes an aperture 314 for facilitating the electrical coupling of wires (not shown) to the luminaire connecting member 214. The exemplary aperture 314 is substantially circular and is of an appropriate size to accept a luminaire connecting member 214, such as the typical prior art luminaire connecting member. However, the aperture 314 may be any shape and size necessary to accommodate any luminaire connecting member 214 that may be used in track lighting systems. The aperture 314 is further surrounded with fastener holes 312 for fastening the track engaging apparatus 200 to the luminaire connecting member 214 and the luminaire connection housing 206. In other configurations, the aperture 314 may not be necessary if the shape of the track engaging apparatus 200 allows for the electrical coupling of the luminaire connecting member 214 to wires in the luminaire connection housing 206 (shown in FIG. 2).

As discussed above, the exemplary track engaging apparatus 200 further includes a rotation inhibitor 204. In an exemplary embodiment, the rotation inhibitor 204 is made from plastic, but may alternatively be made of metal or a composite material. The rotation inhibitor 204 is substantially disposed within the housing 200*a*, but includes a protruding end 204*a* that extends beyond the top wall 200*d* of the housing 200*a*. The rotation inhibitor 204 further includes guide channel engaging members 204*d* that slidably engage with the guide channels 302*a*,304*a*.

The rotation inhibitor 204 further includes a spring compressing member 204*b*. The spring compressing member 204*b* compresses a spring 318 when the rotation inhibitor 204 is disengaged. In the embodiment shown, the spring compressing member 204*b* is a platform that protrudes from the rotation inhibitor 204, although other configurations are possible.

The rotation inhibitor 204 also includes a receiving member 204*c* for interacting with a depressing member 202*c* of the actuator 202. The receiving member 204*c* may also define stop members 204*e* to rest against the top wall 200*d* of the track engaging apparatus 200 when the rotation inhibitor 204 is not actuated by the actuator 202. The receiving member 204*c* will be discussed in further detail below.

The track engaging apparatus 200 further includes a spring bracket 316 fastened to the support member 304*b* by a fastener 318, and engages the spring bracket 316 through a fastener aperture 316*c*. In an exemplary embodiment, the spring bracket 316 is made from metal, but may be made from plastic or a composite material. The spring bracket 316 defines a spring engaging member 316*a* that couples the spring bracket 316 to the spring 318. The exemplary spring engaging member 316*a* is a portion of the spring bracket 316, approximately as wide as the interior diameter of the spring 318, extending perpendicularly from the spring bracket 316 to engage the spring 318.

The spring bracket 316 further includes a notch 316*b*. The notch 316*b* engages the stabilizing member 304*c* on the support member 304*b* and prevents the spring bracket 316 from rotating after being coupled to the support member 304*b*.

The spring engaging member 316*a* engages a spring 318 that is positioned between the spring engaging member 316*a* and the spring compressing member 204*b*. The exemplary spring 318 is a compression spring that is biased to force the spring compressing member 204*b* away from the spring bracket 316 and toward the track 208. Thus, when the track lighting assembly (not shown) is mounted to the track 208, as the spring 318 exerts force away from the spring bracket 316, the spring 318 forces the spring compressing member 204*b* substantially toward the track 208, causing the protruding end 204*a* of the rotation inhibitor 204 to protrude from the track engaging apparatus 200 and engage with a track 208.

The track engaging apparatus 200 further includes an actuator 202 for engaging the receiving member 204*c* of the rotation inhibitor 204. The exemplary actuator 202 is made from plastic, but may be made from metal or a composite material. The exemplary actuator 202 has a substantially rectangular cross section. A first end 202*a* of the actuator may have chamfered corners to provide added comfort to an individual who may press upon it. As discussed above, the first end 202*a* of the actuator 202 is of a size and shape such that it fits within the actuator aperture 306.

The actuator 202 includes an arresting member 202*b*. The arresting member 202*b* may be molded to form a single unit with the actuator 202, or may be a separate member that is coupled to the actuator 202. The arresting member 202*b* is larger than the actuator aperture 306 and prevents any portion of the actuator 202 beyond the arresting member 202*b* from passing through the actuator aperture 306. The exemplary arresting member 202*b* is substantially rectangular in shape and is substantially the same size as the positioning channel 310 formed by the positioning members 308. This exemplary sizing provides added stability for the actuator 202 when it is not engaged with the receiving member 204*c* of the rotation inhibitor 204.

The actuator 202 further includes a depressing member 202*c* which extends from the end of the actuator 202 that is opposite the first end 202*a*. The total length of the actuator 202 is such that when the first end 202*a* is pressed towards the outer wall 200*b* of the housing 200*a*, the depressing member 202*c* will push against the receiving member 204*c* of the rotation inhibitor 204, causing it to move out of engagement with the track 208 as further described with respect to FIG. 4.

Figure 4:
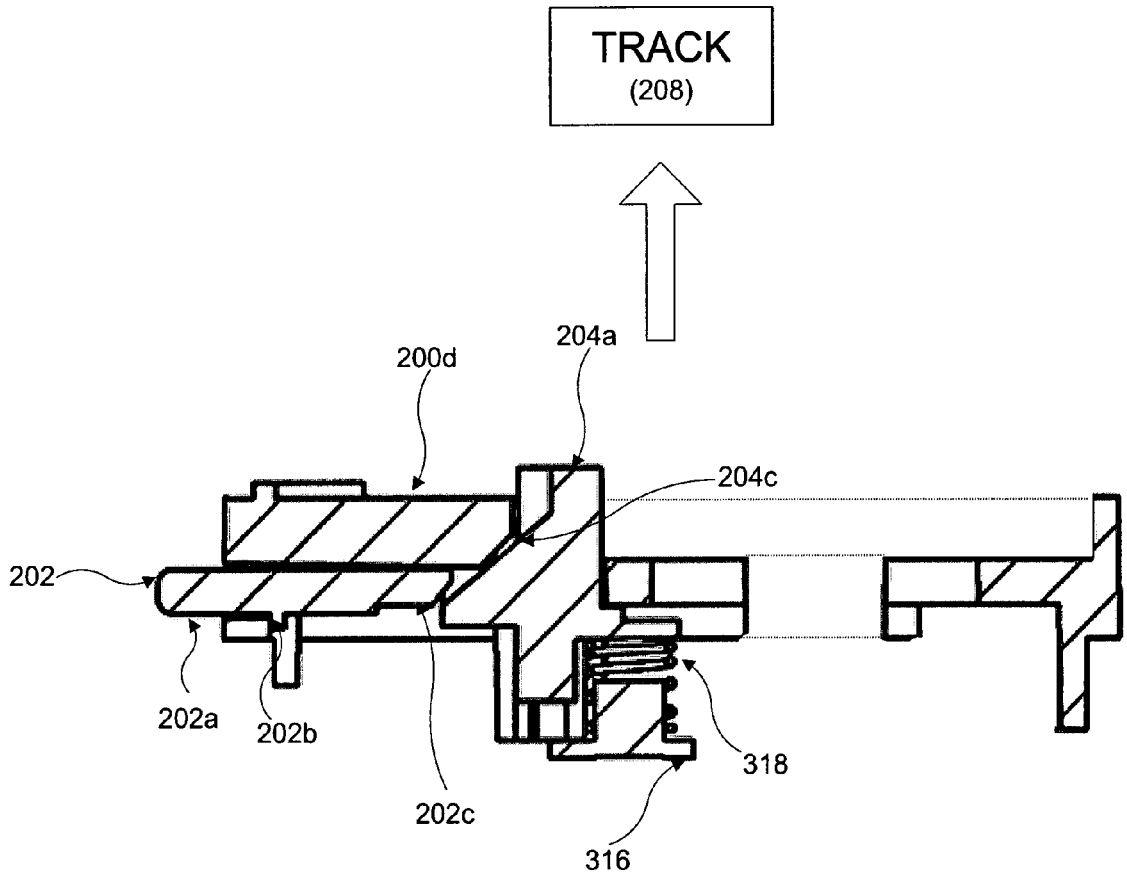
FIG. 4 is a cross-section view of an exemplary track engaging apparatus according to the present invention.

FIG. 4 provides a cross-section of an exemplary track engaging apparatus 200 according to the present invention. The cross-section illustrates the actuator 202 disposed inside the track engaging apparatus 200, with the rotation inhibitor 204, spring 318, and spring bracket 316 assembled thereto. The protruding end 204*a* of the rotation inhibitor 204 can be seen protruding beyond the top wall 200*d* of the track engaging apparatus 200 toward the track 208. The end of the depressing member 202*c* is angled or beveled. The surface of the receiving member 204*c* which is contacted by the depressing member 202*c* is correspondingly angled or beveled such that the depressing member 202*c* and the receiving member 204*c* are disposed flush to one another when engaged. In other embodiments, the depressing member 202*c* and the receiving member 204*c* are not disposed flush to one another.

By disposing the receiving member 204*c* at an angle, the receiving member 204*c* translates force generated by pressing the actuator 202 into motion of the rotation inhibitor 204 that is orthogonal to the direction of the force applied to the actuator 202. As the depressing member 202*c* engages the receiving member 204*c*, the depressing member 202*c* effectively slides along the receiving member 204*c*. Because the actuator 202 is disposed within the track engaging apparatus 200 such that it is substantially prevented from moving in any direction other than the direction of force, and because the rotation inhibitor 204 is disposed such that its guide channel engaging members 204*d* may slide within the guide channel of the track engaging apparatus 200, as the depressing member 202*c* slides along the receiving member 204*c*, the rotation inhibitor 204 moves substantially orthogonally to the direction of force being applied by the actuator 202. In an exemplary embodiment, the rotation inhibitor 204 moves substantially vertically with respect to the actuator 202, and substantially away from the track 208.

The motion away from the track 208 pulls the protruding end 204*a* of the rotation inhibitor 204 towards the track engaging apparatus 200 and out of the slot 210, thereby allowing the track engaging apparatus 200 to rotate freely in the track 208. The motion away from the track 208 further forces the spring compressing member 204*b* to compress the spring 318 against the spring bracket 316. The compressed spring 318 provides a force tending to push the rotation inhibitor 204 toward the track 208. When the force on the actuator 202 is removed, the spring 318 is released and forces the rotation inhibitor 204 toward the track 208. The protruding member 204*a* accordingly returns to a position outside of the track engaging apparatus 200. With the protruding member 204*a* outside of the track engaging apparatus 200, the track engaging apparatus 200 will not rotate within the track 208 when mounted thereto.

According to this aspect of the invention, the track lighting assembly (not shown) can be disengaged from the track 208 by simply pressing the actuator 202 and rotating the track lighting assembly. The individual manipulating the track lighting assembly may simply and easily depress the first end 202*a* of the actuator 202, disengage the rotation inhibitor 204, rotate the track lighting assembly, and remove the track lighting assembly from the track 208. Moreover, because the spring 318 acts to press the rotation inhibitor 204 toward the track 208, the present invention also assists in engaging the rotation inhibitor 204 in the track 208 when installing a track lighting assembly in the track 208. Rotation inhibitors of the prior art required the individual installing the luminaire to precisely align the rotation inhibitor 204 with the slot 210 before engaging the latch. The present invention alleviates this requirement by allowing the individual to simply release the actuator 202 when the luminaire coupling member 214 is engaged with the track 208 and the rotation inhibitor 204 is disposed beneath the track 208. The rotation inhibitor 204 will automatically move into place via the spring force once the rotation inhibitor 204 is properly aligned with the slot 210.

Figure 5:
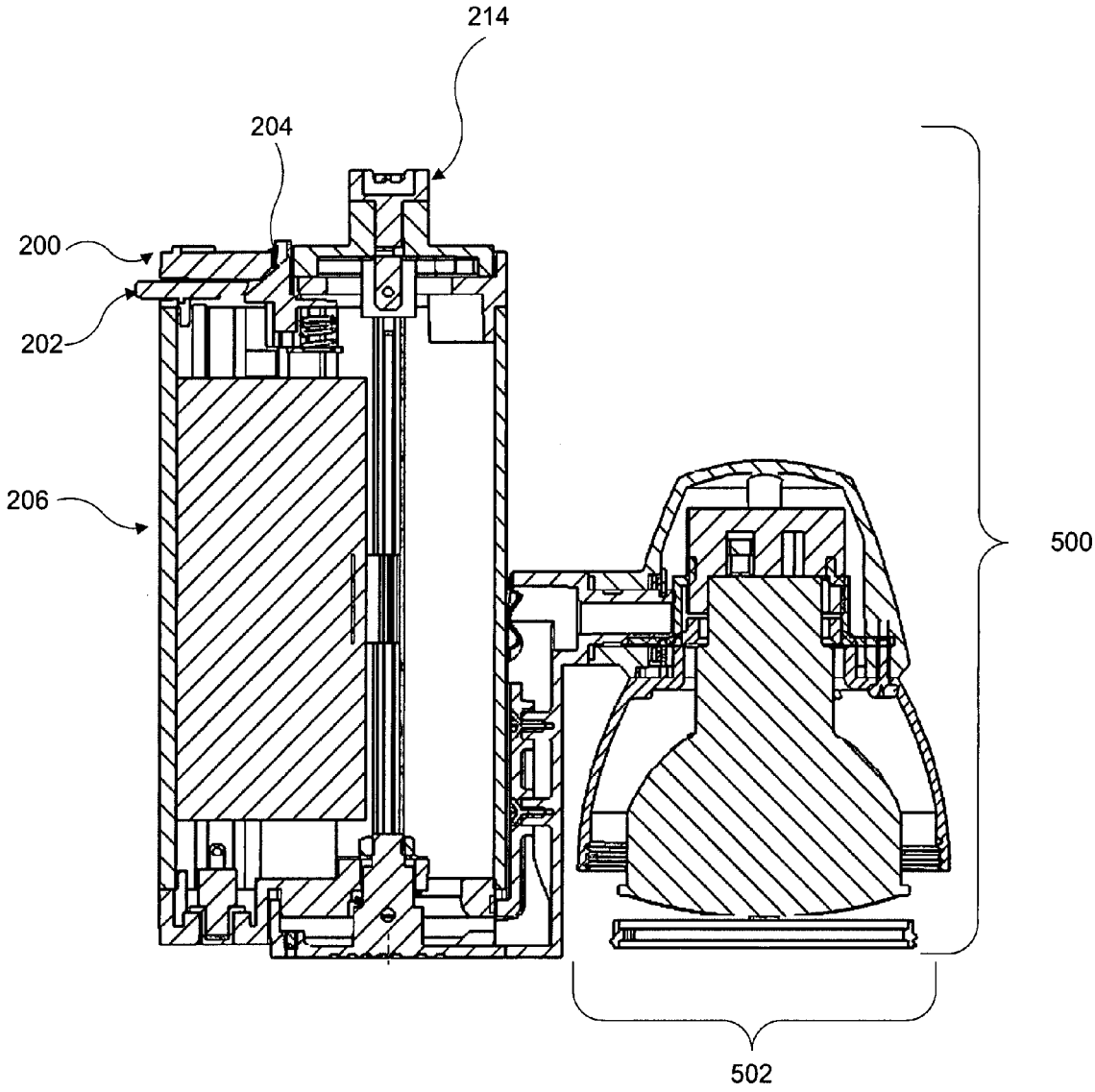
FIG. 5 is a cross section view of an exemplary track engaging apparatus according to the present invention coupled to a luminaire.

FIG. 5 provides a cross-section of an exemplary luminaire 502 coupled to a track engaging apparatus 200 according to the present invention, collectively illustrating a complete track lighting assembly 500 according to the present invention. The track engaging apparatus 200 is coupled to the luminaire connection housing 206, which is further connected to the luminaire 502. The luminaire connecting member 214 is further coupled to the track engaging apparatus 200 as discussed previously. The luminaire connecting member 214 includes the wires (not shown) that electrically couple the luminaire 502 to the luminaire connecting device 214.

Based on the foregoing, it can be seen that the present invention provides a track engaging apparatus which allows a track lighting assembly to be more easily engaged and disengaged from a track in a track lighting system. Many other modifications, features and embodiments of the present invention will become evident to those of skill in the art. It should be appreciated, therefore, that many aspects of the present invention were described above by way of example only and are not intended as required or essential elements of the invention unless explicitly stated otherwise. Accordingly, it should be understood that the foregoing relates only to certain embodiments of the invention and that numerous changes may be made therein without departing from the spirit and scope of the invention as defined by the following claims. It should also be understood that the invention is not restricted to the illustrated embodiments and that various modifications can be made within the scope of the following claims.

What is claimed is:

1. An apparatus for engaging and disengaging a track lighting assembly with respect to a track in a track lighting system, comprising:

a track engaging apparatus comprising a housing;

the housing including a rotation inhibitor, wherein the rotation inhibitor comprises a protruding end that protrudes from the housing for engaging with the track and preventing the track engaging apparatus from rotating with respect to the track;

wherein the rotation inhibitor further includes a receiving member for translating a force in a first direction into motion of the rotation inhibitor in a second direction substantially orthogonal to the first direction; and an actuator for applying the force in the first direction to the receiving member.

2. The apparatus of claim 1, wherein applying the force to the actuator in the first direction disengages the rotation inhibitor from the track.

3. The apparatus of claim 1, wherein the receiving member has a surface disposed at a first angle; and wherein the actuator comprises a depressing member for engaging the surface of the receiving member.

4. The apparatus of claim 3, wherein an end of the depressing member is disposed at a second angle such that the depressing member engages the surface of the receiving member in a flush manner.

5. The apparatus of claim 1, wherein the housing includes an aperture for receiving the actuator.

6. The apparatus of claim 1, wherein the rotation inhibitor is further engaged with a spring, the spring having a bias in a third direction opposite to the second direction.

7. The apparatus of claim 6, further comprising a spring bracket coupled to the housing for holding an end of the spring in place when the rotation inhibitor moves in the second direction.

8. The apparatus of claim 2, wherein removing force from the actuator engages the rotation inhibitor with the track.

9. An apparatus for coupling a track lighting assembly to a track in a track lighting system, comprising:

a luminaire;

a luminaire connection housing coupled to the luminaire, wherein the luminaire connection housing is further coupled to a track engaging apparatus for engaging the track, wherein the track engaging apparatus comprises:

a rotation inhibitor for engaging a slot in the track, wherein the rotation inhibitor prevents the track engaging apparatus from rotating with respect to the track when the rotation inhibitor is engaged in the slot;

the rotation inhibitor further including a receiving member for translating a force in a first direction into motion of the rotation inhibitor in a second direction that is substantially orthogonal to the first direction; and an actuator for engaging the receiving member and applying the force in the first direction.

10. The apparatus of claim 9 wherein the receiving member has a surface disposed at an angle for engaging the actuator.

11. The apparatus of claim 10 wherein the actuator further comprises a depressing member disposed at an angle such that, when the depressing member engages the receiving member, the depressing member is substantially flush with the receiving member.

12. The apparatus of claim 9 wherein the rotation inhibitor engages a spring, the spring having a bias in a third direction opposite to the second direction.

13. The apparatus of claim 12 wherein the spring is coupled to a spring bracket for holding the spring in place as the rotation inhibitor moves in the second direction.

14. An apparatus for coupling and decoupling a track lighting assembly with respect to a track, comprising:

a track engaging apparatus for engaging the track, wherein the track engaging apparatus is coupled to the track lighting assembly;

a luminaire connecting member coupled to the track engaging apparatus, wherein the luminaire connecting member couples the track lighting assembly to the track;

wherein rotating the luminaire connecting member in a first rotational direction couples the luminaire connecting member with the track, and wherein rotating the luminaire connecting member in a second rotational direction decouples the luminaire connecting member from the track; and wherein the track engaging apparatus further comprises:

a rotation inhibitor for engaging a slot in the track to prevent the track engaging apparatus from rotation with respect to the track;

wherein the rotation inhibitor further includes a receiving member for translating a force in a first direction to motion of the rotation inhibitor in a second direction substantially orthogonal to the first direction; and an actuator for engaging the receiving member and applying the force in the first direction to the receiving member.

15. The apparatus of claim 14, further comprising a spring engaged with the rotation inhibitor, the spring having a bias in a third direction opposite the second direction.

16. The apparatus of claim 15 further comprising a spring bracket coupled to a support member and engaging the spring, the spring bracket holding the spring in place against force generated by the motion of the rotation inhibitor in the second direction.

17. The apparatus of claim 14 wherein the receiving member has a surface disposed at an angle for engaging the actuator.

18. The apparatus of claim 17 wherein the actuator further includes a depressing member disposed at an angle for engaging the receiving member, wherein an end of the depressing member is disposed at an angle for engaging the receiving member.

19. The apparatus of claim 14, wherein the second rotational direction is opposite to the first rotational direction.

* * * * *